US006443853B1

(12) United States Patent
Bouquet

(10) Patent No.: US 6,443,853 B1
(45) Date of Patent: Sep. 3, 2002

(54) GOLF CLUBHEAD WITH MINIMIZED MOMENT ARM FOR OFF-CENTER HITS

(76) Inventor: Harry Bouquet, 13582 Mindora Ave., Sylmar, CA (US) 91342

( * ) Notice: Subject to any disclaimer, the term of this patent is extended or adjusted under 35 U.S.C. 154(b) by 0 days.

(21) Appl. No.: 10/103,232

(22) Filed: Mar. 20, 2002

(51) Int. Cl.[7] ..... A63B 53/04; A63B 53/02

(52) U.S. Cl. ..... 473/313; 473/340; 473/349; 473/350

(58) Field of Search ..... 473/324, 325, 473/340, 341, 349, 350, 251, 252, 253, 254, 291, 313, 334, 335, 336, 337, 342; D21/736, 738, 741

(56) References Cited

U.S. PATENT DOCUMENTS 786,268 A * 4/1905 Corey
D94,111 S * 12/1934 Bernardi
2,820,638 A * 1/1958 Morrison
3,037,770 A 6/1962 Palmer
3,567,227 A * 3/1971 Panks
3,625,517 A 12/1971 Durnack
3,751,035 A * 8/1973 Lockwood
4,063,733 A 12/1977 Benedict
4,290,606 A 9/1981 Maxwell
4,795,158 A 1/1989 Kuykendall
4,984,799 A 1/1991 Finney
5,116,054 A * 5/1992 Johnson
5,160,144 A * 11/1992 Maniatis
5,228,332 A * 7/1993 Bernhardt
5,460,375 A * 10/1995 Hardee
5,577,968 A * 11/1996 Pritchett
5,580,322 A * 12/1996 Bouquet
6,019,686 A * 2/2000 Gray
6,273,827 B1 * 8/2001 Hockerson

* cited by examiner

*Primary Examiner*—Sebastiano Passaniti
(74) *Attorney, Agent, or Firm*—Bruce H. Johnsonbaugh

(57) ABSTRACT

A golf clubhead is provided having a flat clubface and a flat rear surface parallel to the clubface. The overall thickness of the clubhead is less than 0.40 inch so that the center of gravity of the clubhead without the hosel is less than 0.20 inch behind the clubface. By achieving a center of gravity this close to the clubface, a minimal moment arm is created when the clubhead strikes a ball off-center so that a minimum loss of distance results from off-center hits and a minimum dispersion results from off-center hits.

7 Claims, 24 Drawing Sheets

| Center Hits | Carry | | Total | | Velocity | | | | | | | |
|---|---|---|---|---|---|---|---|---|---|---|---|---|
| Hit # | Dispersion | Distance | Dispersion | Distance | Ball-f/s | Head-mph | Ball-mph | Ratio | L/A | Spin-rpm | Traj. | Wind-mph |
| 1 | -3 | 175 | -6 | 190 | 184.8066 | 86 | 126 | 1.465 | 10.9 | 2269 | | 4 |
| 2 | 3 | 178 | 6 | 191 | 184.8066 | 89 | 126 | 1.416 | 11.1 | 2383 | | 5 |
| 3 | -4 | 172 | -8 | 195 | 184.8066 | 87 | 126 | 1.448 | 11.3 | 1931 | | 3 |
| 4 | -2 | 176 | 5 | 198 | 183.3398 | 87 | 125 | 1.437 | 10.9 | 2506 | | 3 |
| 5 | 2 | 173 | 2 | 196 | 184.8066 | 89 | 126 | 1.416 | 11.1 | 1977 | | 3 |
| 6 | 10 | 173 | 18 | 201 | 184.8066 | 88 | 126 | 1.432 | 11.1 | 2213 | | 3 |
| 7 | 7 | 178 | 24 | 203 | 184.8066 | 87 | 126 | 1.448 | 10.7 | 2274 | | 2 |
| 8 | 5 | 173 | 10 | 202 | 184.8066 | 87 | 126 | 1.448 | 10.9 | 2269 | | 2 |
| Average | 2.25 | 174.75 | 6.63 | 197.00 | 184.62 | 87.50 | 125.88 | 1.44 | 11.00 | 2227.75 | #DIV/0! | 3.13 |
| Std. Dev. | 5.01 | 2.38 | 10.97 | 4.90 | 0.52 | 1.07 | 0.35 | 0.02 | 0.19 | 192.06 | #DIV/0! | 0.99 |
| Max. | 10.00 | 178.00 | 24.00 | 203.00 | 184.81 | 89.00 | 126.00 | 1.47 | 11.30 | 2506.00 | 0.00 | 5.00 |
| Min. | -4.00 | 172.00 | -8.00 | 190.00 | 183.34 | 86.00 | 125.00 | 1.42 | 10.70 | 1931.00 | 0.00 | 2.00 |
| Range | 14.00 | 6.00 | 32.00 | 13.00 | 1.47 | 3.00 | 1.00 | 0.05 | 0.60 | 575.00 | 0.00 | 3.00 |
| Avg. Dist. From Center | 4.00 | | 9.06 | Roll Distance 22.25 | | | | | | | | |

Fig 6 Club A

| 3/4" Heel Hits | Carry | | Total | | Velocity | | | | | | | |
|---|---|---|---|---|---|---|---|---|---|---|---|---|
| Hit # | Dispersion | Distance | Dispersion | Distance | Ball-f/s | Head-mph | Ball-mph | Ratio | L/A | Spin | Traj. | Wind-mph |
| 1 | 10 | 162 | 10 | 193 | 174.5395 | 87 | 119 | 1.368 | 10.6 | 2076 | | 2 |
| 2 | -5 | 165 | -4 | 193 | 174.5395 | 89 | 119 | 1.337 | 10.3 | 2360 | | 0 |
| 3 | -11 | 166 | -10 | 197 | 176.0062 | 89 | 120 | 1.348 | 10.7 | 2043 | | 0 |
| 4 | 9 | 166 | 10 | 185 | 176.0062 | 88 | 120 | 1.364 | 10.8 | 1992 | | 0 |
| 5 | -7 | 158 | 7 | 178 | 176.0062 | 86 | 120 | 1.395 | 11.2 | 1643 | | 0 |
| 6 | 3 | 157 | 0 | 185 | 176.0062 | 87 | 120 | 1.379 | 11.1 | 1667 | | 0 |
| 7 | -17 | 158 | -26 | 188 | 176.0062 | 86 | 120 | 1.395 | 11.2 | 1535 | | 0 |
| 8 | -2 | 158 | -5 | 190 | 176.0062 | 89 | 120 | 1.348 | 10.9 | 1771 | | 0 |
| Average | -2.50 | 161.25 | -2.25 | 188.63 | 175.64 | 87.63 | 119.75 | 1.37 | 10.85 | 1885.88 | #DIV/0! | 0.25 |
| Std. Dev. | 9.47 | 3.96 | 12.10 | 5.97 | 0.68 | 1.30 | 0.46 | 0.02 | 0.32 | 277.77 | #DIV/0! | 0.71 |
| Max. | 10.00 | 166.00 | 10.00 | 197.00 | 176.01 | 89.00 | 120.00 | 1.40 | 11.20 | 2360.00 | 0.00 | 2.00 |
| Min. | -17.00 | 157.00 | -26.00 | 178.00 | 174.54 | 86.00 | 119.00 | 1.34 | 10.30 | 1535.00 | 0.00 | 0.00 |
| Range | 27.00 | 9.00 | 36.00 | 19.00 | 1.47 | 3.00 | 1.00 | 0.06 | 0.90 | 825.00 | 0.00 | 2.00 |
| Avg. Dist. From Center | 8.56 | | 9.56 | Roll Distance 27.38 | | | | | | | | |

Fig 7 Club A

| 3/4" Toe Hits | Carry | | Total | | Velocity | | | | | | | |
|---|---|---|---|---|---|---|---|---|---|---|---|---|
| Hit # | Dispersion | Distance | Dispersion | Distance | Ball-f/s | Head-mph | Ball-mph | Ratio | L/A | Spin | Traj. | Wind-mph |
| 1 | 9 | 173 | 11 | 196 | 183.3398 | 88 | 125 | 1.42 | 10.8 | 2863 | | 2 |
| 2 | 0 | 171 | 0 | 195 | 183.3398 | 87 | 125 | 1.437 | 10.9 | 2481 | | 2 |
| 3 | 12 | 168 | 20 | 198 | 183.3398 | 86 | 125 | 1.453 | 11.3 | 2216 | | 2 |
| 4 | 17 | 165 | 14 | 189 | 181.8731 | 87 | 124 | 1.425 | 11.4 | 2250 | | 2 |
| 5 | 20 | 164 | 22 | 192 | 181.8731 | 89 | 124 | 1.393 | 11.2 | 1900 | | 2 |
| 6 | 8 | 165 | 4 | 175 | 180.4064 | 91 | 123 | 1.352 | 11.4 | 2008 | | 2 |
| 7 | 13 | 169 | 19 | 185 | 181.8731 | 87 | 124 | 1.425 | 11.6 | 1985 | | 3 |
| 8 | 3 | 163 | 3 | 194 | 180.4064 | 89 | 123 | 1.382 | 11.7 | 1746 | | 2 |
| Average | 10.25 | 167.25 | 11.63 | 190.50 | 182.06 | 88.00 | 124.13 | 1.41 | 11.29 | 2181.13 | #DIV/0! | 2.13 |
| Std. Dev. | 6.71 | 3.58 | 8.50 | 7.50 | 1.22 | 1.60 | 0.83 | 0.03 | 0.31 | 358.10 | #DIV/0! | 0.35 |
| Max. | 20.00 | 173.00 | 22.00 | 198.00 | 183.34 | 91.00 | 125.00 | 1.45 | 11.70 | 2863.00 | 0.00 | 3.00 |
| Min. | 0.00 | 163.00 | 0.00 | 175.00 | 180.41 | 86.00 | 123.00 | 1.35 | 10.80 | 1746.00 | 0.00 | 2.00 |
| Range | 20.00 | 10.00 | 22.00 | 23.00 | 2.93 | 5.00 | 2.00 | 0.10 | 0.90 | 1117.00 | 0.00 | 1.00 |
| Avg. Dist. From Center | 8.56 | | 9.94 | Roll Distance 23.25 | | | | | | | | |

Fig 8 Club A

| Center Hits | Carry | | Total | | Velocity | | | | | | | |
|---|---|---|---|---|---|---|---|---|---|---|---|---|
| Hit # | Dispersion | Distance | Dispersion | Distance | Ball-f/s | Head-mph | Ball-mph | Ratio | L/A | Spin-rpm | Traj. | Wind-mph |
| 1 | 2 | 170 | 0 | 202 | 187.74 | 88 | 128 | 1.455 | 8.7 | 2348 | | 0 |
| 2 | 17 | 171 | 13 | 198 | 187.74 | 92 | 128 | 1.391 | 8.8 | 2229 | | 0 |
| 3 | 6 | 172 | 16 | 201 | 189.2067 | 89 | 129 | 1.449 | 8.9 | 2477 | | 0 |
| 4 | 7 | 171 | 8 | 196 | 187.74 | 91 | 128 | 1.407 | 8.7 | 2384 | | 0 |
| 5 | -4 | 165 | 2 | 199 | 186.2733 | 90 | 127 | 1.411 | 9 | 2418 | | 0 |
| 6 | 0 | 171 | -5 | 198 | 189.2067 | 89 | 129 | 1.449 | 8.7 | 2425 | | 0 |
| 7 | 4 | 172 | 7 | 197 | 189.2067 | 90 | 129 | 1.433 | 9.1 | 2381 | | 0 |
| 8 | 9 | 168 | 11 | 196 | 187.74 | 91 | 128 | 1.407 | 9.2 | 2057 | | 0 |
| Average | 5.13 | 170.00 | 6.50 | 198.38 | 188.11 | 90.00 | 128.25 | 1.43 | 8.89 | 2339.88 | #DIV/0! | 0.00 |
| Std. Dev. | 6.33 | 2.39 | 7.07 | 2.20 | 1.04 | 1.31 | 0.71 | 0.02 | 0.20 | 135.31 | #DIV/0! | 0.00 |
| Max. | 17.00 | 172.00 | 16.00 | 202.00 | 189.21 | 92.00 | 129.00 | 1.45 | 9.20 | 2477.00 | 0.00 | 0.00 |
| Min. | -4.00 | 165.00 | -5.00 | 196.00 | 186.27 | 88.00 | 127.00 | 1.39 | 8.70 | 2057.00 | 0.00 | 0.00 |
| Range | 21.00 | 7.00 | 21.00 | 6.00 | 2.93 | 4.00 | 2.00 | 0.06 | 0.50 | 420.00 | 0.00 | 0.00 |
| Avg. Dist. From Center | 4.63 | | 5.97 | Roll Distance 28.38 | | | | | | | | |

Fig 10 Club B

| 3/4" Heel Hits | Carry | | Total | | Velocity | | | | | | | |
|---|---|---|---|---|---|---|---|---|---|---|---|---|
| Hit # | Dispersion | Distance | Dispersion | Distance | Ball-f/s | Head-mph | Ball-mph | Ratio | L/A | Spin | Traj. | Wind-mph |
| 1 | -3 | 154 | -3 | 181 | 177.473 | 91 | 121 | 1.33 | 8.2 | 2245 | | 5 |
| 2 | -9 | 155 | -16 | 184 | 180.4064 | 91 | 123 | 1.352 | 8.6 | 2129 | | 5 |
| 3 | -9 | 157 | -16 | 186 | 178.9397 | 88 | 122 | 1.386 | 8.4 | 1948 | | 5 |
| 4 | -7 | 158 | -11 | 186 | 177.473 | 91 | 121 | 1.33 | 8.4 | 2076 | | 3 |
| 5 | -6 | 152 | 6 | 178 | 178.9397 | 87 | 122 | 1.402 | 8.3 | 2067 | | 3 |
| 6 | -8 | 153 | -10 | 184 | 177.473 | 89 | 121 | 1.36 | 8.6 | 2177 | | 3 |
| 7 | -4 | 153 | -16 | 183 | 177.473 | 88 | 121 | 1.375 | 8.5 | 2169 | | 5 |
| 8 | -8 | 156 | 0 | 183 | 177.473 | 91 | 121 | 1.33 | 8.3 | 2001 | | 3 |
| Average | -6.75 | 154.75 | -8.25 | 183.13 | 178.21 | 89.50 | 121.50 | 1.36 | 8.41 | 2101.50 | #DIV/0! | 4.00 |
| Std. Dev. | 2.25 | 2.12 | 8.36 | 2.64 | 1.11 | 1.69 | 0.76 | 0.03 | 0.15 | 97.91 | #DIV/0! | 1.07 |
| Max. | -3.00 | 158.00 | 6.00 | 186.00 | 180.41 | 91.00 | 123.00 | 1.40 | 8.60 | 2245.00 | 0.00 | 5.00 |
| Min. | -9.00 | 152.00 | -16.00 | 178.00 | 177.47 | 87.00 | 121.00 | 1.33 | 8.20 | 1948.00 | 0.00 | 3.00 |
| Range | 6.00 | 6.00 | 22.00 | 8.00 | 2.93 | 4.00 | 2.00 | 0.07 | 0.40 | 297.00 | 0.00 | 2.00 |
| Avg. Dist. From Center | 11.88 | | 13.59 | Roll Distance 28.38 | | | | | | | | |

Fig 11 Club B

| 3/4" Toe Hits | Carry | | Total | | Velocity | | | | | | | |
|---|---|---|---|---|---|---|---|---|---|---|---|---|
| Hit # | Dispersion | Distance | Dispersion | Distance | Ball-f/s | Head-mph | Ball-mph | Ratio | L/A | Spin | Traj. | Wind-mph |
| 1 | 17 | 164 | 22 | 187 | 184.8066 | 90 | 126 | 1.4 | 9.3 | 2458 | | 3 |
| 2 | 8 | 162 | -5 | 183 | 183.3398 | 88 | 125 | 1.42 | 9.3 | 2470 | | 5 |
| 3 | -2 | 156 | 2 | 176 | 181.8731 | 89 | 124 | 1.393 | 9.3 | 2301 | | 5 |
| 4 | -6 | 164 | -1 | 195 | 184.8066 | 89 | 126 | 1.416 | 9.4 | 2257 | | 3 |
| 5 | 0 | 159 | -7 | 185 | 183.3398 | 88 | 125 | 1.42 | 9.4 | 2291 | | 3 |
| 6 | -11 | 158 | -15 | 176 | 184.8066 | 92 | 126 | 1.37 | 9 | 2185 | | 5 |
| 7 | -3 | 158 | -9 | 191 | 183.3398 | 91 | 125 | 1.374 | 9.2 | 2167 | | 5 |
| 8 | 0 | 156 | -9 | 190 | 183.3398 | 91 | 125 | 1.374 | 9.4 | 1952 | | 5 |
| Average | 0.38 | 159.63 | -2.75 | 185.38 | 183.71 | 89.75 | 125.25 | 1.40 | 9.29 | 2260.13 | #DIV/0! | 4.25 |
| Std. Dev. | 8.63 | 3.29 | 11.27 | 6.86 | 1.04 | 1.49 | 0.71 | 0.02 | 0.14 | 166.94 | #DIV/0! | 1.04 |
| Max. | 17.00 | 164.00 | 22.00 | 195.00 | 184.81 | 92.00 | 126.00 | 1.42 | 9.40 | 2470.00 | 0.00 | 5.00 |
| Min. | -11.00 | 156.00 | -15.00 | 176.00 | 181.87 | 88.00 | 124.00 | 1.37 | 9.00 | 1952.00 | 0.00 | 3.00 |
| Range | 28.00 | 8.00 | 37.00 | 19.00 | 2.93 | 4.00 | 2.00 | 0.05 | 0.40 | 518.00 | 0.00 | 2.00 |
| Avg. Dist. From Center | 8.44 | | 12.09 | Roll Distance 25.75 | | | | | | | | |

Fig 12 Club B

| Center Hits | Carry | | Total | | Velocity | | | | | | | |
|---|---|---|---|---|---|---|---|---|---|---|---|---|
| Hit # | Dispersion | Distance | Dispersion | Distance | Ball-f/s | Head-mph | Ball-mph | Ratio | L/A | Spin-rpm | Traj. | Wind-mph |
| 1 | -1 | 187 | -11 | 210 | 189.2067 | 88 | 129 | 1.466 | 12.9 | 2268 | | 0 |
| 2 | -8 | 188 | -5 | 206 | 189.2067 | 89 | 129 | 1.449 | 12.1 | 3111 | | 2 |
| 3 | 6 | 187 | 13 | 204 | 190.6734 | 90 | 130 | 1.444 | 12.7 | 2720 | | 3 |
| 4 | -7 | 186 | -7 | 203 | 189.2067 | 89 | 129 | 1.449 | 12.3 | 2547 | | 3 |
| 5 | 4 | 190 | 3 | 206 | 189.2067 | 90 | 129 | 1.433 | 12.3 | 3099 | | 3 |
| 6 | -11 | 189 | -9 | 206 | 189.2067 | 90 | 129 | 1.433 | 12.2 | 3082 | | 3 |
| 7 | 0 | 189 | 1 | 206 | 190.6734 | 92 | 130 | 1.413 | 12.1 | 3077 | | 3 |
| 8 | -7 | 189 | -4 | 208 | 189.2067 | 92 | 129 | 1.402 | 12.1 | 2999 | | 3 |
| Average | -3.00 | 188.13 | -2.38 | 206.13 | 189.57 | 90.00 | 129.25 | 1.44 | 12.34 | 2862.88 | #DIV/0! | 2.50 |
| Std. Dev. | 6.14 | 1.36 | 7.80 | 2.17 | 0.68 | 1.41 | 0.46 | 0.02 | 0.30 | 317.08 | #DIV/0! | 1.07 |
| Max. | 6.00 | 190.00 | 13.00 | 210.00 | 190.67 | 92.00 | 130.00 | 1.47 | 12.90 | 3111.00 | 0.00 | 3.00 |
| Min. | -11.00 | 186.00 | -11.00 | 203.00 | 189.21 | 88.00 | 129.00 | 1.40 | 12.10 | 2268.00 | 0.00 | 0.00 |
| Range | 17.00 | 4.00 | 24.00 | 7.00 | 1.47 | 4.00 | 1.00 | 0.06 | 0.80 | 843.00 | 0.00 | 3.00 |
| Avg. Dist. From Center | 5.25 | | 5.88 | Roll Distance 18.00 | | | | | | | | |

Fig 14 Club C

| 3/4" Heel Hits | Carry | | Total | | Velocity | | | | | | | |
|---|---|---|---|---|---|---|---|---|---|---|---|---|
| Hit # | Dispersion | Distance | Dispersion | Distance | Ball-f/s | Head-mph | Ball-mph | Ratio | L/A | Spin | Traj. | Wind-mph |
| 1 | -5 | 173 | -10 | 194 | 178.9397 | 91 | 122 | 1.341 | 12.1 | 2593 | | 2 |
| 2 | -12 | 176 | -17 | 195 | 180.4064 | 90 | 123 | 1.367 | 12 | 2344 | | 2 |
| 3 | 1 | 172 | 0 | 186 | 180.4064 | 91 | 123 | 1.352 | 12.4 | 1937 | | 0 |
| 4 | -17 | 163 | 0 | 189 | 178.9397 | 92 | 122 | 1.326 | 12.5 | 1685 | | 0 |
| 5 | -4 | 171 | -5 | 197 | 180.4064 | 92 | 123 | 1.337 | 12.6 | 1880 | | 0 |
| 6 | -2 | 170 | 10 | 193 | 178.9397 | 90 | 122 | 1.356 | 12.5 | 1848 | | 0 |
| 7 | -10 | 168 | -11 | 196 | 178.9397 | 90 | 122 | 1.356 | 12.6 | 1734 | | 0 |
| 8 | -6 | 164 | -3 | 199 | 178.9397 | 89 | 122 | 1.371 | 12.5 | 1390 | | 0 |
| Average | -6.88 | 169.63 | -4.50 | 193.63 | 179.49 | 90.63 | 122.38 | 1.35 | 12.40 | 1926.38 | #DIV/0! | 0.50 |
| Std. Dev. | 5.82 | 4.44 | 8.30 | 4.27 | 0.76 | 1.06 | 0.52 | 0.02 | 0.23 | 379.88 | #DIV/0! | 0.93 |
| Max. | 1.00 | 176.00 | 10.00 | 199.00 | 180.41 | 92.00 | 123.00 | 1.37 | 12.60 | 2593.00 | 0.00 | 2.00 |
| Min. | -17.00 | 163.00 | -17.00 | 186.00 | 178.94 | 89.00 | 122.00 | 1.33 | 12.00 | 1390.00 | 0.00 | 0.00 |
| Range | 18.00 | 13.00 | 27.00 | 13.00 | 1.47 | 3.00 | 1.00 | 0.04 | 0.60 | 1203.00 | 0.00 | 2.00 |
| Avg. Dist. From Center | 5.13 | | 6.25 | Roll Distance 24.00 | | | | | | | | |

Fig 15 Club C

| 3/4" Toe Hits | Carry | | Total | | Velocity | | | | | | | |
|---|---|---|---|---|---|---|---|---|---|---|---|---|
| Hit # | Dispersion | Distance | Dispersion | Distance | Ball-f/s | Head-mph | Ball-mph | Ratio | L/A | Spin | Traj. | Wind-mph |
| 1 | 7 | 177 | 3 | 194 | 186.2733 | 90 | 127 | 1.411 | 12.4 | 2547 | | 3 |
| 2 | -7 | 178 | -2 | 204 | 186.2733 | 90 | 127 | 1.411 | 12.9 | 2534 | | 3 |
| 3 | -14 | 175 | -16 | 191 | 184.8066 | 90 | 126 | 1.4 | 13 | 2173 | | 2 |
| 4 | 10 | 168 | 15 | 177 | 186.2733 | 89 | 127 | 1.427 | 13.3 | 1816 | | 3 |
| 5 | 11 | 173 | 15 | 194 | 186.2733 | 91 | 127 | 1.396 | 13.3 | 1988 | | 2 |
| 6 | 4 | 174 | 4 | 198 | 186.2733 | 88 | 127 | 1.443 | 13 | 2240 | | 3 |
| 7 | 5 | 178 | 6 | 202 | 186.2733 | 90 | 127 | 1.411 | 12.7 | 2237 | | 2 |
| 8 | -13 | 180 | -11 | 193 | 186.2733 | 90 | 127 | 1.411 | 12.5 | 2558 | | 2 |
| Average | 0.38 | 175.38 | 1.75 | 194.13 | 186.09 | 89.75 | 126.88 | 1.41 | 12.89 | 2261.63 | #DIV/0! | 2.50 |
| Std. Dev. | 10.17 | 3.78 | 11.13 | 8.27 | 0.52 | 0.89 | 0.35 | 0.02 | 0.34 | 274.08 | #DIV/0! | 0.53 |
| Max. | 11.00 | 180.00 | 15.00 | 204.00 | 186.27 | 91.00 | 127.00 | 1.44 | 13.30 | 2558.00 | 0.00 | 3.00 |
| Min. | -14.00 | 168.00 | -16.00 | 177.00 | 184.81 | 88.00 | 126.00 | 1.40 | 12.40 | 1816.00 | 0.00 | 2.00 |
| Range | 25.00 | 12.00 | 31.00 | 27.00 | 1.47 | 3.00 | 1.00 | 0.05 | 0.90 | 742.00 | 0.00 | 1.00 |
| Avg. Dist. From Center | 9.63 | | 10.00 | Roll Distance 18.75 | | | | | | | | |

Fig 16 Club C

| Center Hits | Carry | | Total | | Velocity | | | | | | | |
|---|---|---|---|---|---|---|---|---|---|---|---|---|
| Hit # | Dispersion | Distance | Dispersion | Distance | Ball-f/s | Head-mph | Ball-mph | Ratio | L/A | Spin-rpm | Traj. | Wind-mph |
| 1 | 0 | 163 | 13 | 185 | 187.74 | 89 | 128 | 1.438 | 8.2 | 1977 | | 3 |
| 2 | 8 | 162 | 8 | 184 | 187.74 | 92 | 128 | 1.391 | 8.5 | 1769 | | 3 |
| 3 | 13 | 164 | 13 | 194 | 187.74 | 89 | 128 | 1.438 | 8.4 | 1965 | | 2 |
| 4 | 16 | 164 | 16 | 197 | 187.74 | 88 | 128 | 1.455 | 8 | 2014 | | 2 |
| 5 | 2 | 162 | 12 | 190 | 187.74 | 90 | 128 | 1.422 | 8.5 | 1977 | | 0 |
| 6 | 3 | 163 | 6 | 189 | 187.74 | 90 | 128 | 1.422 | 8.3 | 1941 | | 0 |
| 7 | 7 | 164 | 3 | 184 | 186.2733 | 90 | 127 | 1.411 | 8.7 | 1698 | | 0 |
| 8 | 13 | 155 | 8 | 166 | 187.74 | 92 | 128 | 1.391 | 8 | 1875 | | 0 |
| Average | 7.75 | 162.13 | 9.88 | 186.13 | 187.56 | 90.00 | 127.88 | 1.42 | 8.33 | 1902.00 | #DIV/0! | 1.25 |
| Std. Dev. | 5.85 | 3.00 | 4.32 | 9.40 | 0.52 | 1.41 | 0.35 | 0.02 | 0.25 | 112.96 | #DIV/0! | 1.39 |
| Max. | 16.00 | 164.00 | 16.00 | 197.00 | 187.74 | 92.00 | 128.00 | 1.45 | 8.70 | 2014.00 | 0.00 | 3.00 |
| Min. | 0.00 | 155.00 | 3.00 | 166.00 | 186.27 | 88.00 | 127.00 | 1.39 | 8.00 | 1698.00 | 0.00 | 0.00 |
| Range | 16.00 | 9.00 | 13.00 | 31.00 | 1.47 | 4.00 | 1.00 | 0.06 | 0.70 | 316.00 | 0.00 | 3.00 |
| Avg. Dist. From Center | 4.75 | | 3.75 | Roll Distance 24.00 | | | | | | | | |

Fig 18 Club D

| 3/4" Heel Hits | Carry | | Total | | Velocity | | | | | | | |
|---|---|---|---|---|---|---|---|---|---|---|---|---|
| Hit # | Dispersion | Distance | Dispersion | Distance | Ball-f/s | Head-mph | Ball-mph | Ratio | L/A | Spin | Traj. | Wind-mph |
| 1 | -2 | 149 | 4 | 176 | 174.5395 | 90 | 119 | 1.322 | 7.5 | 1860 | | 0 |
| 2 | 8 | 145 | 13 | 167 | 174.5395 | 92 | 119 | 1.293 | 7.4 | 2203 | | 2 |
| 3 | -15 | 136 | -15 | 171 | 174.5395 | 89 | 119 | 1.337 | 8 | 1737 | | 2 |
| 4 | -3 | 140 | 0 | 168 | 176.0062 | 89 | 120 | 1.348 | 7.7 | 1923 | | 1 |
| 5 | 5 | 143 | 6 | 169 | 176.0062 | 88 | 120 | 1.364 | 7.8 | 1799 | | 0 |
| 6 | -8 | 146 | -15 | 184 | 176.0062 | 90 | 120 | 1.333 | 7.4 | 1869 | | 0 |
| 7 | -9 | 140 | 0 | 172 | 176.0062 | 88 | 120 | 1.364 | 8 | 1812 | | 0 |
| 8 | -1 | 147 | -4 | 170 | 176.0062 | 91 | 120 | 1.319 | 7.9 | 1797 | | 0 |
| Average | -3.13 | 143.25 | -1.38 | 172.13 | 175.46 | 89.63 | 119.63 | 1.34 | 7.71 | 1875.00 | #DIV/0! | 0.63 |
| Std. Dev. | 7.51 | 4.33 | 9.80 | 5.54 | 0.76 | 1.41 | 0.52 | 0.02 | 0.25 | 143.94 | #DIV/0! | 0.92 |
| Max. | 8.00 | 149.00 | 13.00 | 184.00 | 176.01 | 92.00 | 120.00 | 1.36 | 8.00 | 2203.00 | 0.00 | 2.00 |
| Min. | -15.00 | 136.00 | -15.00 | 167.00 | 174.54 | 88.00 | 119.00 | 1.29 | 7.40 | 1737.00 | 0.00 | 0.00 |
| Range | 23.00 | 13.00 | 28.00 | 17.00 | 1.47 | 4.00 | 1.00 | 0.07 | 0.60 | 466.00 | 0.00 | 2.00 |
| Avg. Dist. From Center | 10.94 | | 10.44 | Roll Distance 28.88 | | | | | | | | |

Fig 19 Club D

| 3/4" Toe Hits | Carry | | Total | | Velocity | | | | | | | |
|---|---|---|---|---|---|---|---|---|---|---|---|---|
| Hit # | Dispersion | Distance | Dispersion | Distance | Ball-f/s | Head-mph | Ball-mph | Ratio | L/A | Spin | Traj. | Wind-mph |
| 1 | 7 | 160 | 11 | 184 | 186.2733 | 89 | 127 | 1.427 | 8.7 | 2092 | | 0 |
| 2 | 17 | 155 | 24 | 173 | 186.2733 | 88 | 127 | 1.443 | 8.7 | 2212 | | 0 |
| 3 | 2 | 158 | 0 | 184 | 186.2733 | 90 | 127 | 1.411 | 8.7 | 2033 | | 0 |
| 4 | 10 | 157 | -1 | 188 | 186.2733 | 93 | 127 | 1.366 | 8.7 | 1889 | | 1 |
| 5 | 16 | 159 | 21 | 178 | 186.2733 | 90 | 127 | 1.411 | 8.6 | 2060 | | 1 |
| 6 | 16 | 156 | 32 | 190 | 184.8066 | 91 | 126 | 1.385 | 8.9 | 2038 | | 0 |
| 7 | 6 | 156 | 9 | 184 | 186.2733 | 88 | 127 | 1.443 | 8.8 | 2076 | | 0 |
| 8 | 5 | 160 | 10 | 180 | 184.8066 | 88 | 126 | 1.432 | 8.8 | 1832 | | 0 |
| Average | 9.88 | 157.63 | 13.25 | 182.63 | 185.91 | 89.63 | 126.75 | 1.41 | 8.74 | 2029.00 | #DIV/0! | 0.25 |
| Std. Dev. | 5.79 | 1.92 | 11.59 | 5.48 | 0.68 | 1.77 | 0.46 | 0.03 | 0.09 | 119.00 | #DIV/0! | 0.46 |
| Max. | 17.00 | 160.00 | 32.00 | 190.00 | 186.27 | 93.00 | 127.00 | 1.44 | 8.90 | 2212.00 | 0.00 | 1.00 |
| Min. | 2.00 | 155.00 | -1.00 | 173.00 | 184.81 | 88.00 | 126.00 | 1.37 | 8.60 | 1832.00 | 0.00 | 0.00 |
| Range | 15.00 | 5.00 | 33.00 | 17.00 | 1.47 | 5.00 | 1.00 | 0.08 | 0.30 | 380.00 | 0.00 | 1.00 |
| Avg. Dist. From Center | 4.88 | | 9.63 | Roll Distance 25.00 | | | | | | | | |

Fig 20 Club D

| Center Hits | Carry | | Total | | Velocity | | | | | | | |
|---|---|---|---|---|---|---|---|---|---|---|---|---|
| Hit # | Dispersion | Distance | Dispersion | Distance | Ball-f/s | Head-mph | Ball-mph | Ratio | L/A | Spin-rpm | Traj. | Wind-mph |
| 1 | -10 | 181 | -10 | 210 | 187.74 | 89 | 128 | 1.438 | 10.7 | 2404 | | 5 |
| 2 | -14 | 177 | -11 | 197 | 189.2067 | 87 | 129 | 1.483 | 10.8 | 2184 | | 3 |
| 3 | -12 | 178 | -13 | 206 | 189.2067 | 91 | 129 | 1.418 | 11 | 2069 | | 3 |
| 4 | -4 | 172 | 3 | 206 | 189.2067 | 88 | 129 | 1.466 | 10.5 | 2319 | | 3 |
| 5 | -18 | 179 | -21 | 196 | 187.74 | 90 | 128 | 1.422 | 11 | 2054 | | 3 |
| 6 | -17 | 175 | -19 | 200 | 190.6734 | 90 | 130 | 1.444 | 11.1 | 1902 | | 2 |
| 7 | -5 | 179 | -3 | 205 | 187.74 | 90 | 128 | 1.422 | 10.9 | 1982 | | 0 |
| 8 | -9 | 179 | -7 | 208 | 187.74 | 87 | 128 | 1.471 | 11 | 2016 | | 3 |
| Average | -11.13 | 177.50 | -10.13 | 203.50 | 188.66 | 89.00 | 128.63 | 1.45 | 10.88 | 2116.25 | #DIV/0! | 2.75 |
| Std. Dev. | 5.14 | 2.83 | 7.92 | 5.18 | 1.09 | 1.51 | 0.74 | 0.03 | 0.20 | 172.62 | #DIV/0! | 1.39 |
| Max. | -4.00 | 181.00 | 3.00 | 210.00 | 190.67 | 91.00 | 130.00 | 1.48 | 11.10 | 2404.00 | 0.00 | 5.00 |
| Min. | -18.00 | 172.00 | -21.00 | 196.00 | 187.74 | 87.00 | 128.00 | 1.42 | 10.50 | 1902.00 | 0.00 | 0.00 |
| Range | 14.00 | 9.00 | 24.00 | 14.00 | 2.93 | 4.00 | 2.00 | 0.07 | 0.60 | 502.00 | 0.00 | 5.00 |
| Avg. Dist. From Center | 4.13 | | 5.91 | Roll Distance 26.00 | | | | | | | | |

Fig 22 Club E

| 1/2" Heel Hits | Carry | | Total | | Velocity | | | | | | | |
|---|---|---|---|---|---|---|---|---|---|---|---|---|
| Hit # | Dispersion | Distance | Dispersion | Distance | Ball-f/s | Head-mph | Ball-mph | Ratio | L/A | Spin | Traj. | Wind-mph |
| 1 | -11 | 164 | -19 | 193 | 186.2733 | 88 | 127 | 1.443 | 10.1 | 2527 | | 3 |
| 2 | -12 | 165 | -8 | 193 | 186.2733 | 89 | 127 | 1.427 | 10.9 | 1897 | | 2 |
| 3 | -5 | 164 | -2 | 189 | 186.2733 | 90 | 127 | 1.411 | 10.7 | 1905 | | 3 |
| 4 | -11 | 163 | -7 | 198 | 184.8066 | 90 | 126 | 1.4 | 10.6 | 1688 | | 3 |
| 5 | -4 | 158 | -4 | 180 | 187.74 | 91 | 128 | 1.407 | 10.6 | 1952 | | 5 |
| 6 | -6 | 160 | -15 | 193 | 184.8066 | 90 | 126 | 1.4 | 10.4 | 2194 | | 3 |
| 7 | -15 | 174 | -2 | 187 | 184.8066 | 90 | 126 | 1.4 | 10.2 | 2186 | | 3 |
| 8 | -24 | 164 | -17 | 183 | 186.2733 | 91 | 127 | 1.396 | 10.5 | 1946 | | 3 |
| Average | -11.00 | 164.00 | -9.25 | 189.50 | 185.91 | 89.88 | 126.75 | 1.41 | 10.50 | 2036.88 | #DIV/0! | 3.13 |
| Std. Dev. | 6.50 | 4.69 | 6.84 | 5.95 | 1.04 | 0.99 | 0.71 | 0.02 | 0.26 | 256.70 | #DIV/0! | 0.83 |
| Max. | -4.00 | 174.00 | -2.00 | 198.00 | 187.74 | 91.00 | 128.00 | 1.44 | 10.90 | 2527.00 | 0.00 | 5.00 |
| Min. | -24.00 | 158.00 | -19.00 | 180.00 | 184.81 | 88.00 | 126.00 | 1.40 | 10.10 | 1688.00 | 0.00 | 2.00 |
| Range | 20.00 | 16.00 | 17.00 | 18.00 | 2.93 | 3.00 | 2.00 | 0.05 | 0.80 | 839.00 | 0.00 | 3.00 |
| Avg. Dist. From Center | 4.53 | | 6.28 | Roll Distance 25.50 | | | | | | | | |

Fig 23 Club E

| 1/2" Toe Hits | Carry | | Total | | Velocity | | | | | | | |
|---|---|---|---|---|---|---|---|---|---|---|---|---|
| Hit # | Dispersion | Distance | Dispersion | Distance | Ball-f/s | Head-mph | Ball-mph | Ratio | L/A | Spin | Traj. | Wind-mph |
| 1 | -12 | 169 | -9 | 179 | 186.2733 | 89 | 127 | 1.427 | 10.6 | 2469 | | 2 |
| 2 | -13 | 174 | -14 | 198 | 187.74 | 91 | 128 | 1.407 | 10.9 | 2279 | | 2 |
| 3 | -3 | 164 | 18 | 178 | 187.74 | 89 | 128 | 1.438 | 10.7 | 2352 | | 3 |
| 4 | -4 | 174 | -5 | 196 | 190.6734 | 88 | 130 | 1.477 | 9.9 | 2412 | | 3 |
| 5 | 0 | 172 | 6 | 186 | 192.1401 | 88 | 131 | 1.489 | 11.1 | 1856 | | 3 |
| 6 | 0 | 170 | 0 | 197 | 192.1401 | 87 | 131 | 1.506 | 11.1 | 2335 | | 2 |
| 7 | -8 | 169 | -10 | 188 | 195.0736 | 90 | 133 | 1.478 | 11.1 | 2258 | | 1 |
| 8 | -5 | 171 | -9 | 179 | 193.6069 | 90 | 132 | 1.467 | 11.1 | 2101 | | 1 |
| Average | -5.63 | 170.38 | -2.88 | 187.63 | 190.67 | 89.00 | 130.00 | 1.46 | 10.81 | 2257.75 | #DIV/0! | 2.13 |
| Std. Dev. | 4.98 | 3.25 | 10.53 | 8.53 | 3.14 | 1.31 | 2.14 | 0.03 | 0.42 | 196.29 | #DIV/0! | 0.83 |
| Max. | 0.00 | 174.00 | 18.00 | 198.00 | 195.07 | 91.00 | 133.00 | 1.51 | 11.10 | 2469.00 | 0.00 | 3.00 |
| Min. | -13.00 | 164.00 | -14.00 | 178.00 | 186.27 | 87.00 | 127.00 | 1.41 | 9.90 | 1856.00 | 0.00 | 1.00 |
| Range | 13.00 | 10.00 | 32.00 | 20.00 | 8.80 | 4.00 | 6.00 | 0.10 | 1.20 | 613.00 | 0.00 | 2.00 |
| Avg. Dist. From Center | 6.19 | | 8.97 | Roll Distance 17.25 | | | | | | | | |

Fig 24 Club E

GOLF CLUBHEAD WITH MINIMIZED MOMENT ARM FOR OFF-CENTER HITS

BACKGROUND AND BRIEF SUMMARY OF INVENTION

The present invention relates in general to a metallic golf clubhead design. More particularly, the present invention provides a clubhead design wherein the center of gravity of the clubhead minus the hosel is extremely close (less than 0.20 inches) to the clubface. By positioning the center of gravity very close to the clubface, the moment arm which imparts side spin to the ball for off-center hits is reduced to a minimum. Furthermore, the side spin imparted to the ball will tend to return the ball to its intended line of flight, assuming that the clubhead is normal to the intended target line at the moment of impact.

The present invention provides an improvement over the design shown in my U.S. Pat. No. 5,580,322 dated Dec. 3, 1996. In particular, the present invention reduces the distance between the clubface and the clubhead center of gravity by approximately 50%, from 0.40 inches in the design of U.S. Pat. No. 5,580,322 to 0.20 inches in the present invention.

A primary object of the invention is to provide a metallic clubhead design utilizing a flat clubface together with a center of gravity located less than 0.20 inches behind the clubface, in order to minimize the moment arm which imparts side spin to the ball for off-center hits.

A further object of the invention is to provide a metallic golf clubhead design utilizing a thin clubhead having a minimized distance between the clubface and the backface of the clubhead in order to keep the center of gravity close to the clubface.

Yet another object of the invention is to provide a clubhead having a symmetrical design (apart from the hosel) of the heel and toe relative to a vertical axis extending through the center of gravity of the clubhead.

A further object of the invention is to provide a clubhead design wherein off-center hits within 0.75 inches of the center of the clubhead will impart a reduced amount of side spin to the ball and wherein the side spin will tend to return the ball to its intended target line, assuming the clubhead is normal to the intended target line at the instant of impact.

Yet another object of the invention is to provide a golf clubhead for use in a driving iron which is capable of achieving very uniform shot results including distance and dispersion, particularly where the clubhead is normal to the intended target line at the instant of impact.

Further objects and advantages of the invention will become apparent from the following description and drawings, wherein:

BRIEF DESCRIPTION OF THE DRAWINGS

FIG. 6 is a tabular summary of test results for Club A with respect to center hits;

FIG. 7 is a tabular summary of test results for Club A with respect to heel hits;

FIG. 8 is a tabular summary of test results for Club A with respect to toe hits;

FIG. 10 is a tabular summary of test results for Club B with respect to center hits;

FIG. 11 is a tabular summary of test results for Club B with respect to heel hits;

FIG. 12 is a tabular summary of test results for Club B with respect to toe hits;

FIG. 14 is a tabular summary of test results for Club C with respect to center hits;

FIG. 15 is a tabular summary of test results for Club C with respect to heel hits;

FIG. 16 is a tabular summary of test results for Club C with respect to toe hits;

FIG. 18 is a tabular summary of test results for Club D with respect to center hits;

FIG. 19 is a tabular summary of test results for Club D with respect to heel hits;

FIG. 20 is a tabular summary of test results for Club D with respect to toe hits;

FIG. 22 is a tabular summary of test results for Club E with respect to center hits;

FIG. 23 is a tabular summary of test results for Club E with respect to heel hits; and FIG. 24 is a tabular summary of test results for Club E with respect to toe hits.

DETAILED DESCRIPTION OF THE DRAWINGs

Figure 1:
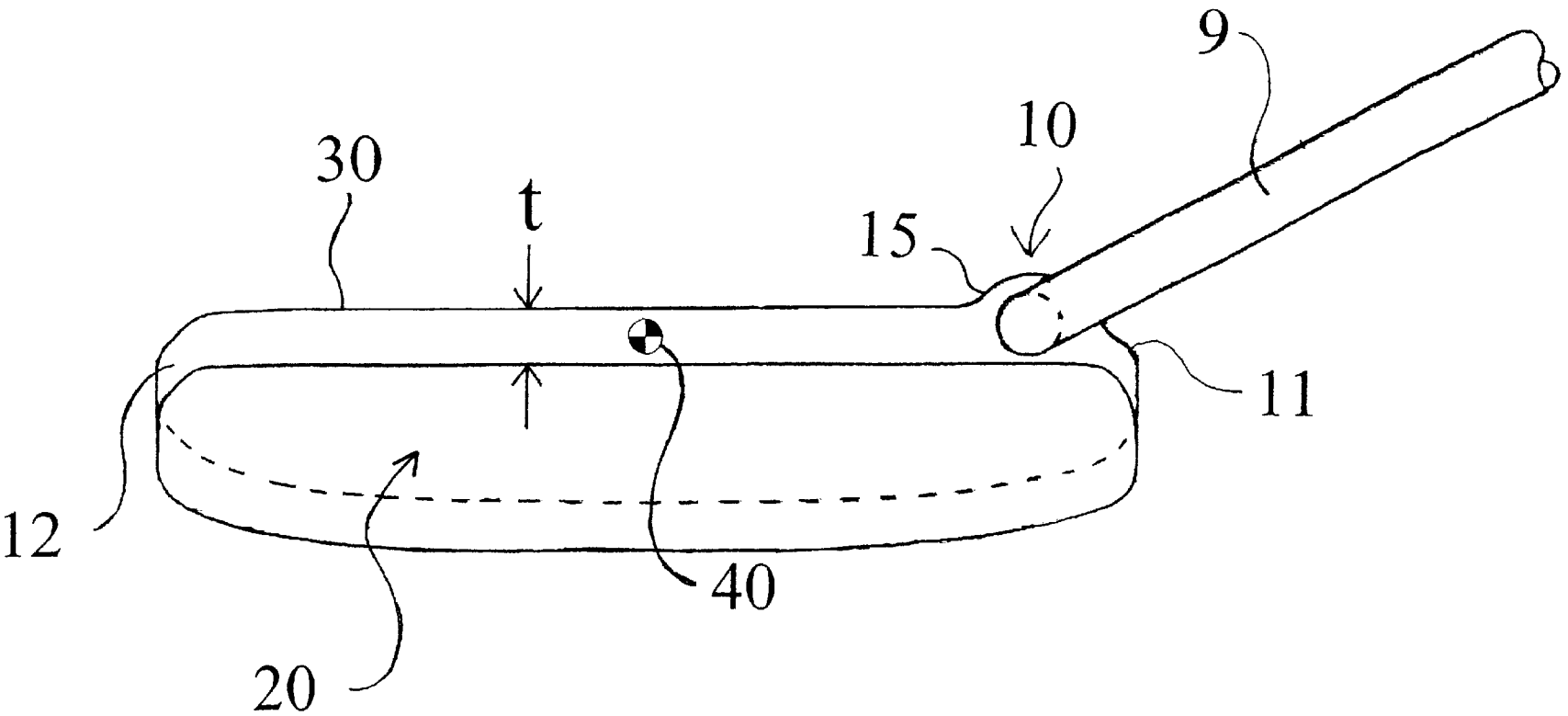
FIG. 1 is a top view of the clubhead according to the present invention.
Figure 2:
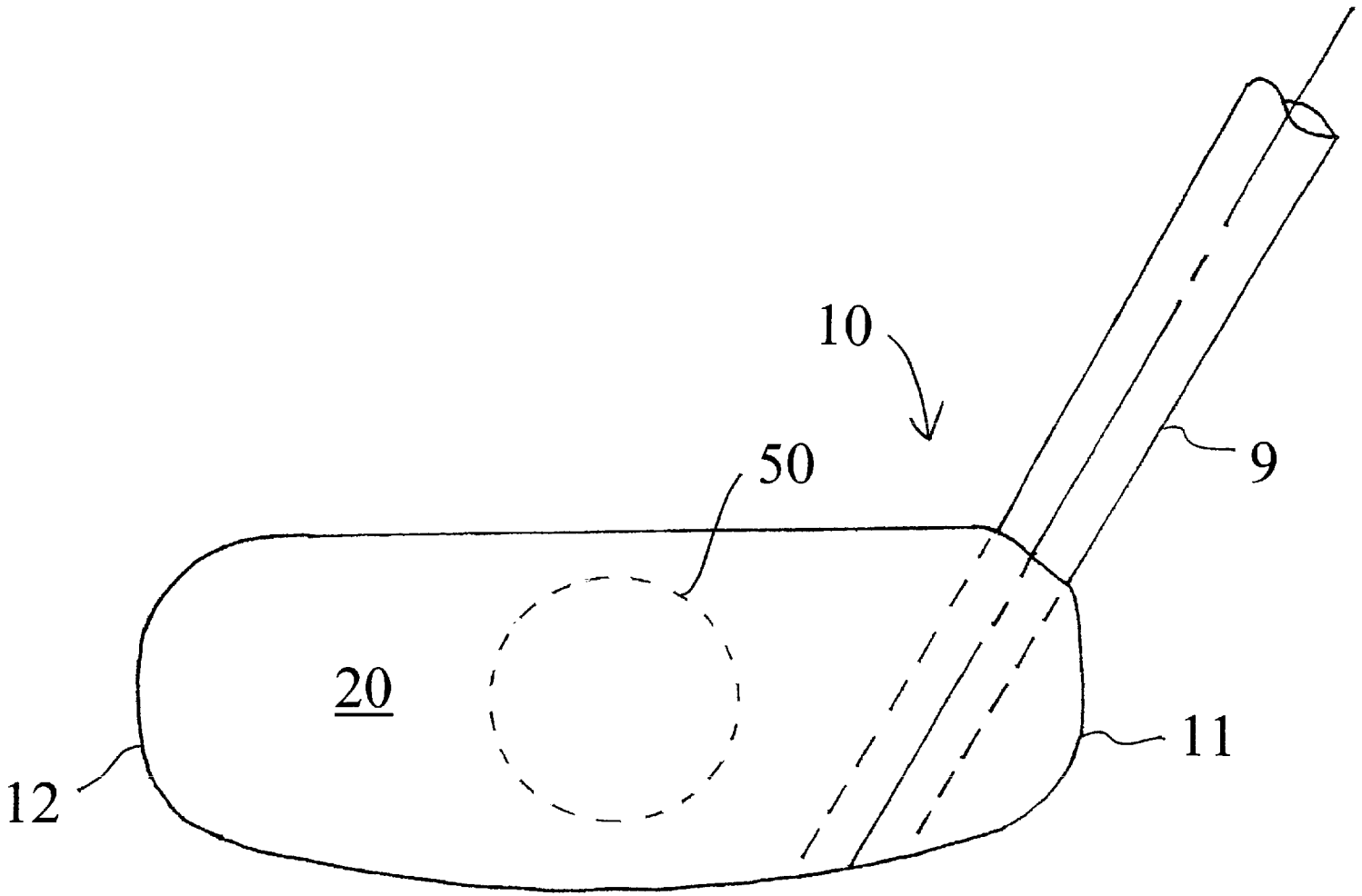
FIG. 2 is a front elevational view showing the clubface and a portion of the shaft.
Figure 3:
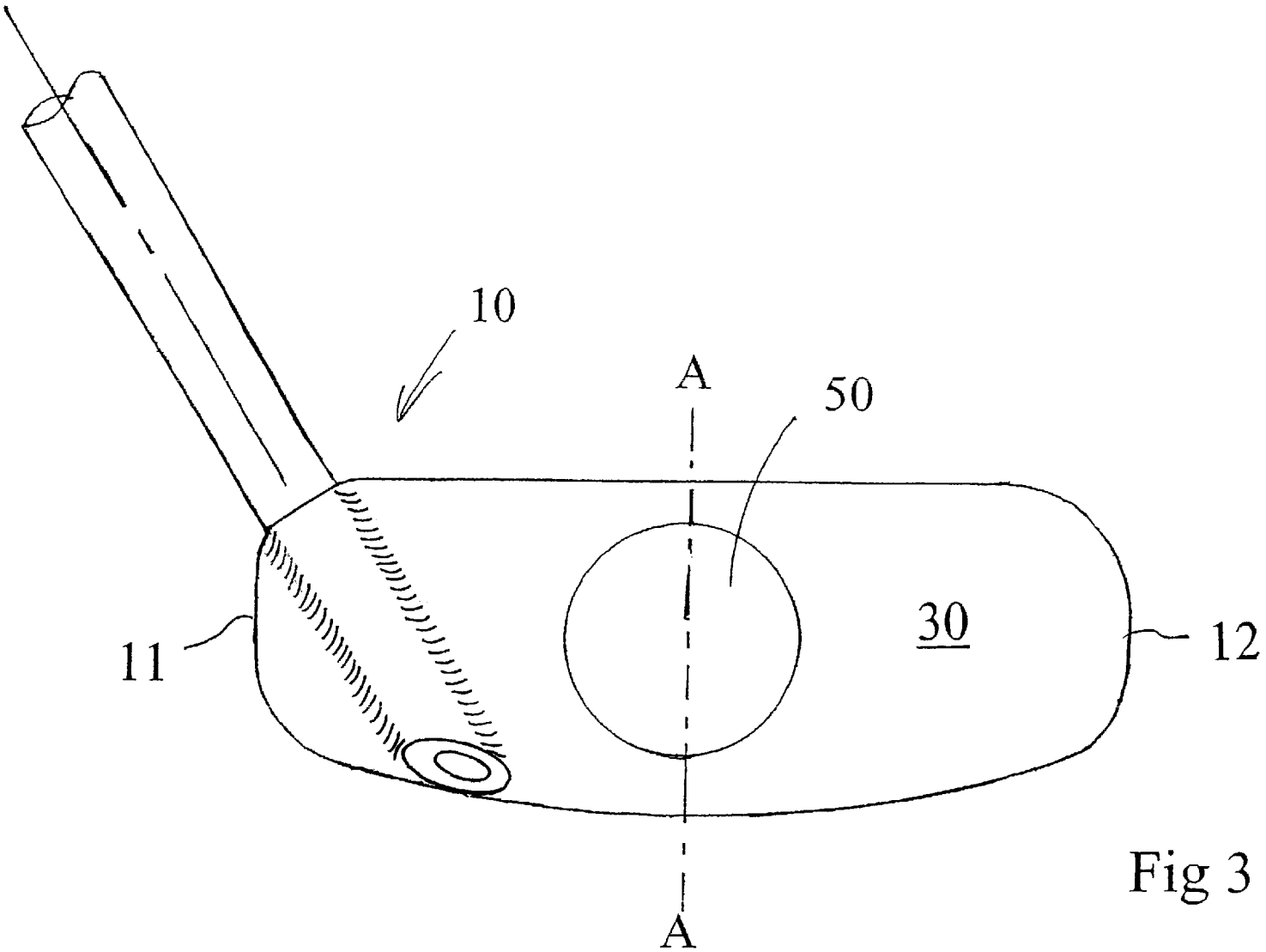
FIG. 3 is a rear elevational view showing the back of the club and a portion of the shaft.
Figure 4:
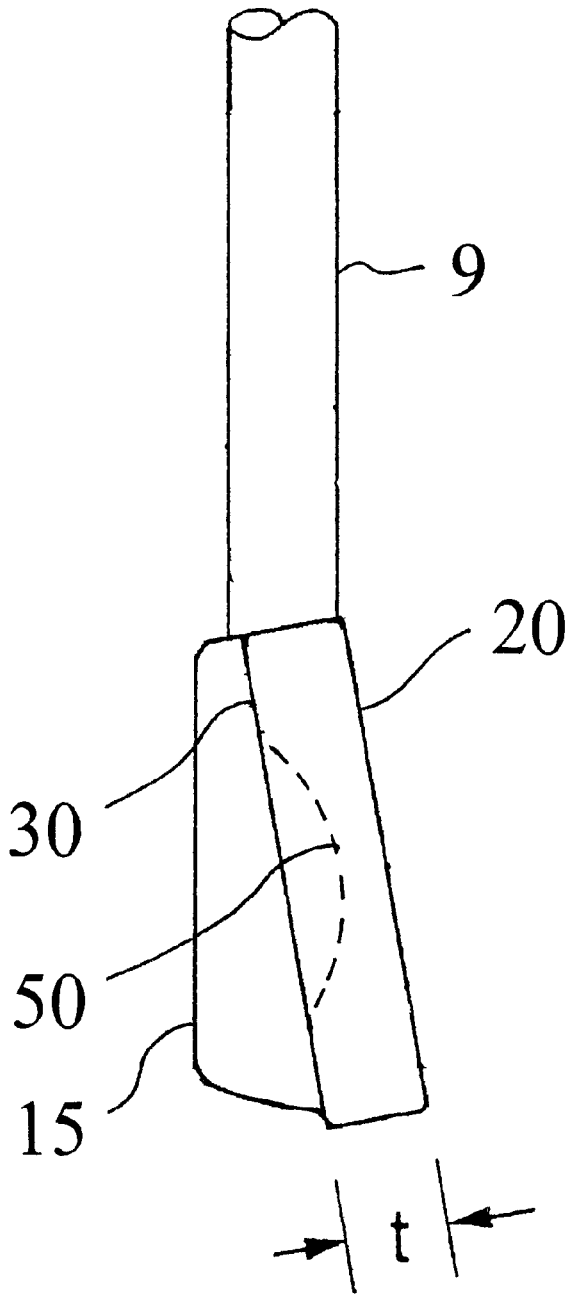
FIG. 4 is a side elevational view looking at the toe of the clubhead.
Figure 5:
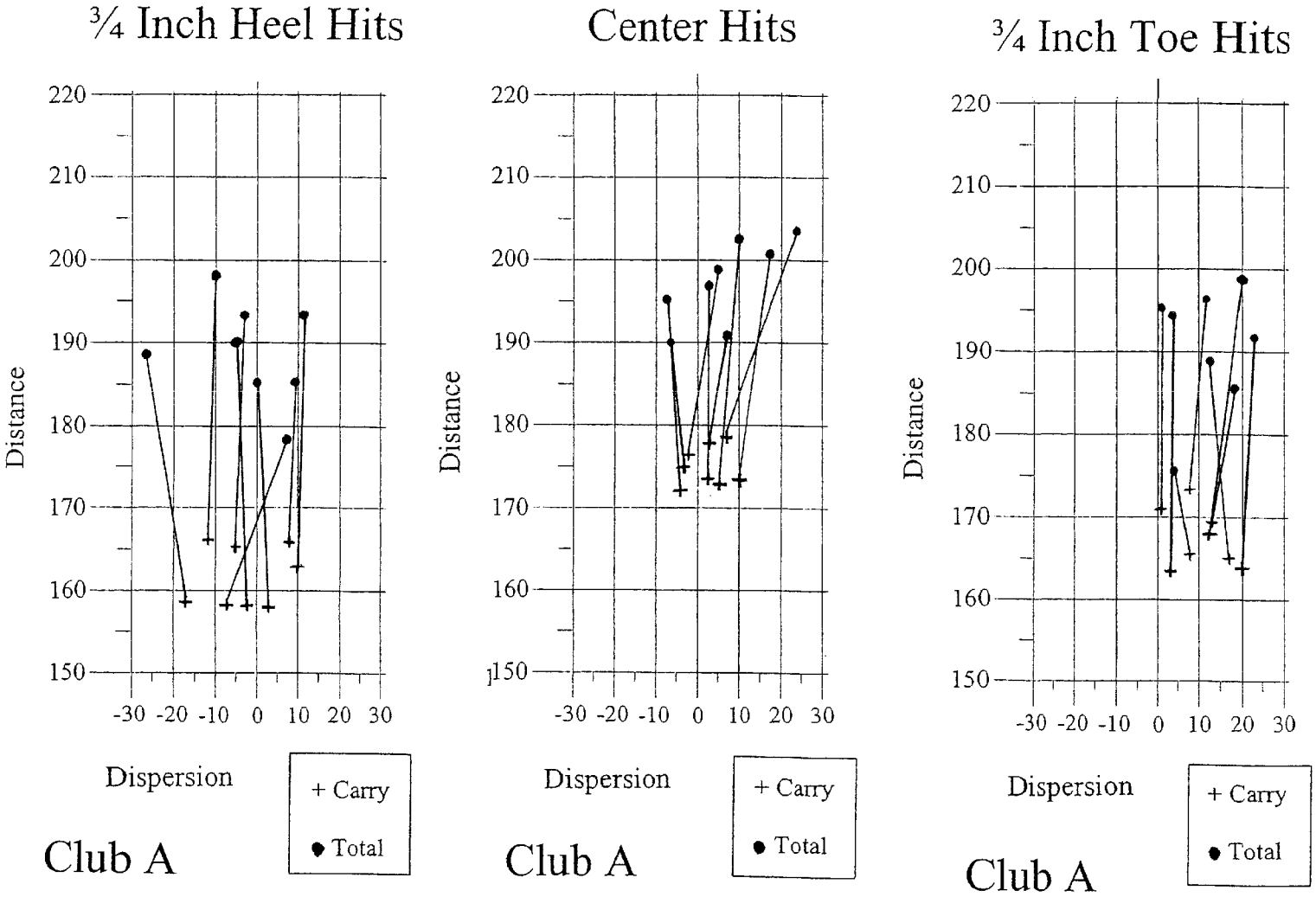
FIG. 5 is a graphical summary of independent laboratory robotic testing of the invention as embodied in Club A.
Figure 9:
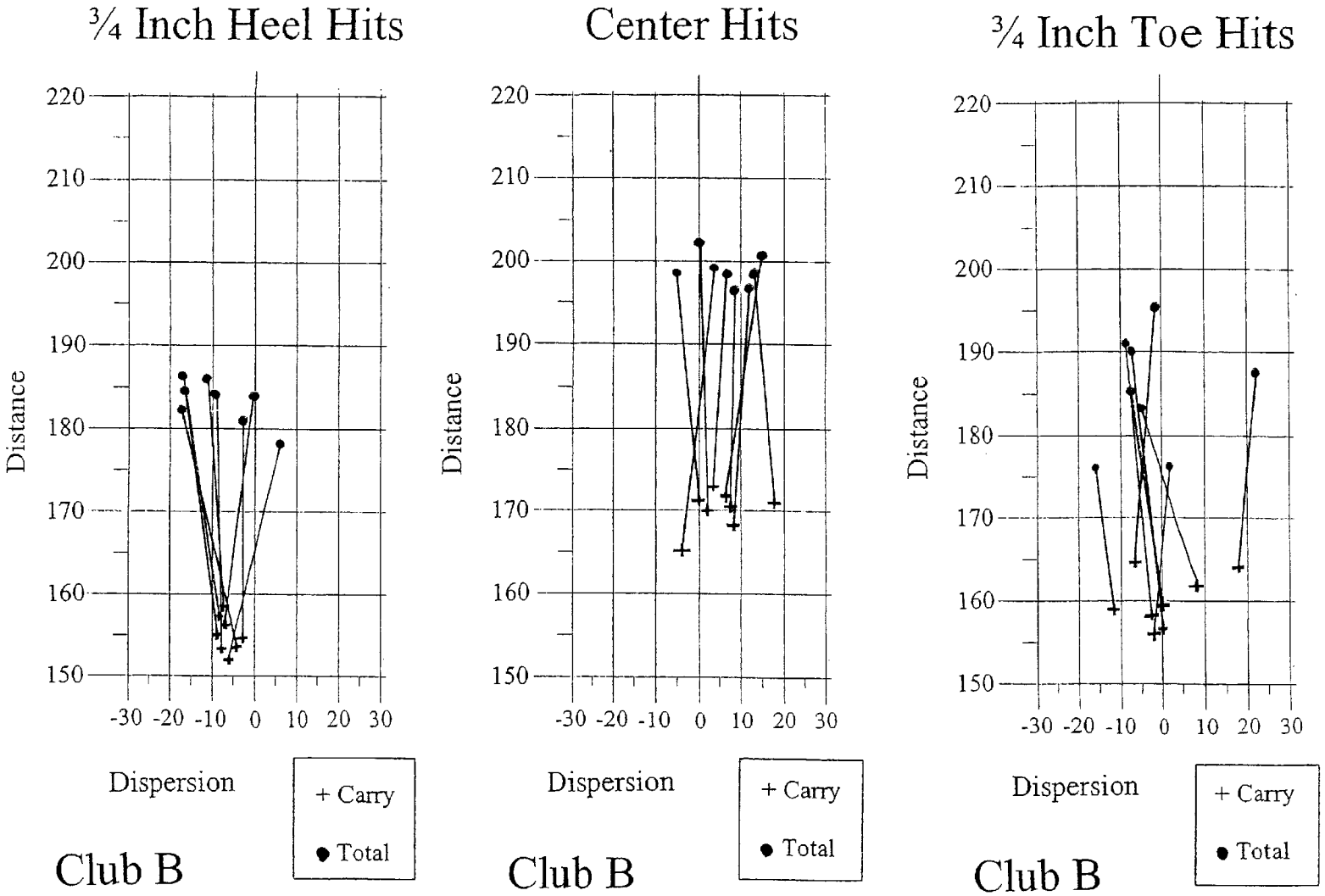
FIG. 9 is a graphical summary of independent laboratory robotic testing of the invention as embodied in Club B.

FIGS. 1–4 show a metallic clubhead generally as 10. The clubhead includes a heel portion 11 and a toe portion 12. The heel portion 11 is adapted to receive a tubular clubshaft 9 through hosel 15.

The clubface 20 is flat having no bulge or roll radius. The overall length of clubface 20 from heel 11 to toe 12 is between 4.0 and 4.1 inches.

The metallic clubhead 10 has a rear surface 30 which is flat and parallel to clubface 20. The overall thickness "t" between clubface 20 and the rear surface 30 of clubhead 10 is less than 0.40 inch.

The center of gravity of clubhead 10 (not including hosel 15) is shown as reference numeral 40 in FIG. 1. The center of gravity 40 is located less than 0.20 inch behind clubface 20. I have found that, by placing the center of gravity 40 as close as possible to clubface 20, a minimal moment arm is created when the clubhead 10 strikes a ball off-center. I have also found that the said minimal moment arm tends to impart a small amount of side spin to the ball to return the flight of the ball to its intended path, provided that clubface 20 is perpendicular to the intended path at the moment of impact.

The clubhead 10 may be forged or cast. The clubhead 10 is symmetrical about a vertical axis A-A extending through the center of gravity 40 of the clubhead, apart from the hosel. That is, if the hosel 15 is removed, the remainder of the clubhead is symmetrical about vertical axis A-A.

In the preferred embodiment, the rear surface 30 of the clubhead is parallel with clubface 20. In order to further advance the center of gravity towards the clubface, a spherical relief 50 may be formed in the back surface 30 of the clubhead. The formation of relief 50 may also be utilized to achieve uniformity of swing weight between several clubs in any given set. By forming the shallow spherical recess 50 in the rear surface of the clubhead, the center of gravity can be advanced to within or less than 0.15 inch behind the clubface.

Independent tests were conducted on five various clubs, each of which incorporated the features of the invention. The five clubs were each subjected to robotic testing. For each of the five clubs, eight balls were hit at the center of the clubface, eight balls were hit three-fourths of an inch off-center towards the toe, and eight balls were hit three-fourths of an inch off-center towards the heel. All hits were made with the clubface normal to the intended target line. Each clubhead had a thickness "t" of 0.375 inch and the center of gravity is 0.1875 inch behind the clubface.

FIGS. 5–24 are graphical representations and tabular summaries, showing the distance and dispersion for both carry and total distance. Distance measurements are in yards, dispersion measurements are in feet. Clubhead velocity is shown in miles-per-hour, ball velocity is shown in feet per second and miles-per-hour. The ball spin rate, launch angle (L/A) and wind speed are also listed for each hit.

Figure 13:
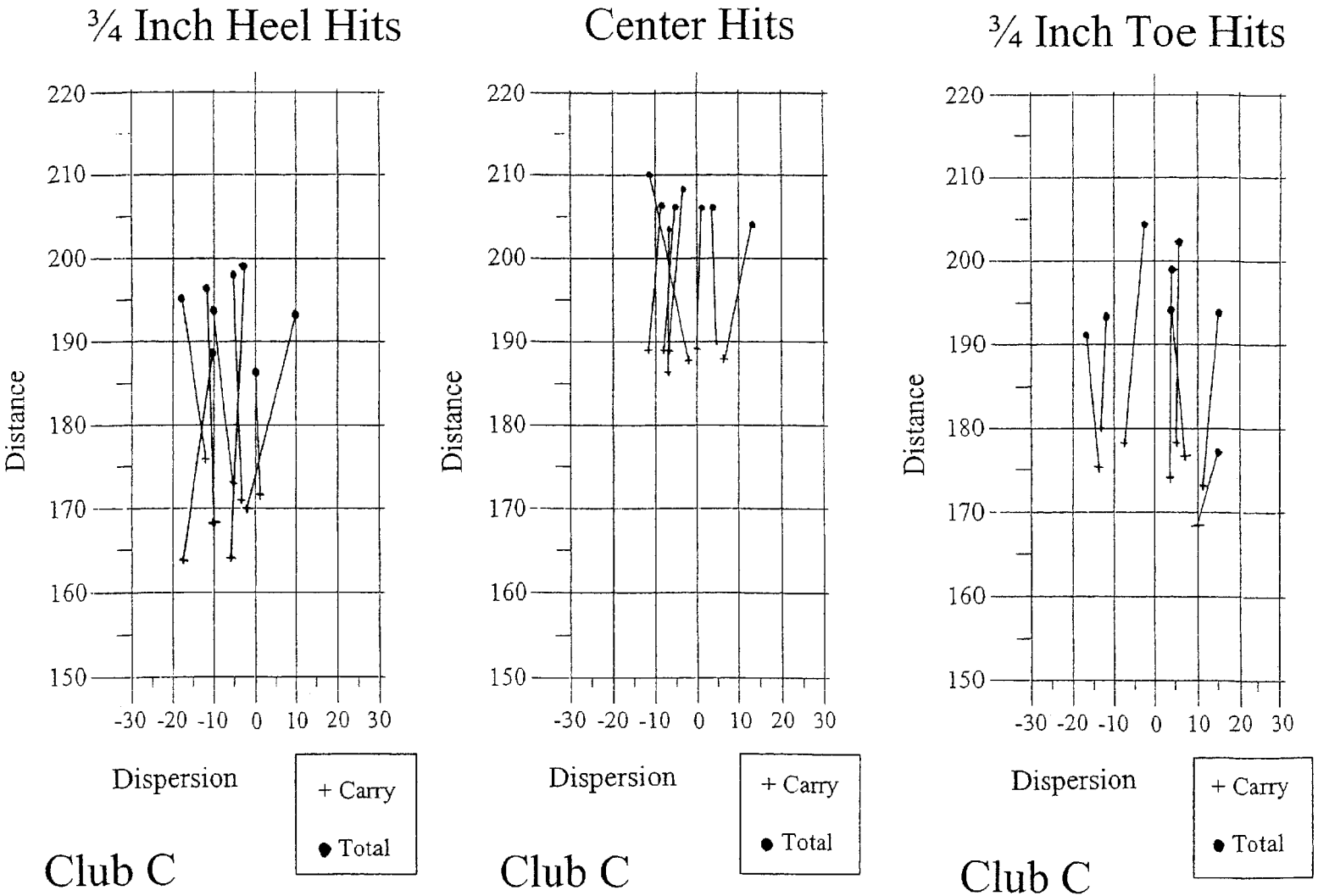
FIG. 13 is a graphical summary of independent laboratory robotic testing of the invention as embodied in Club C.
Figure 17:
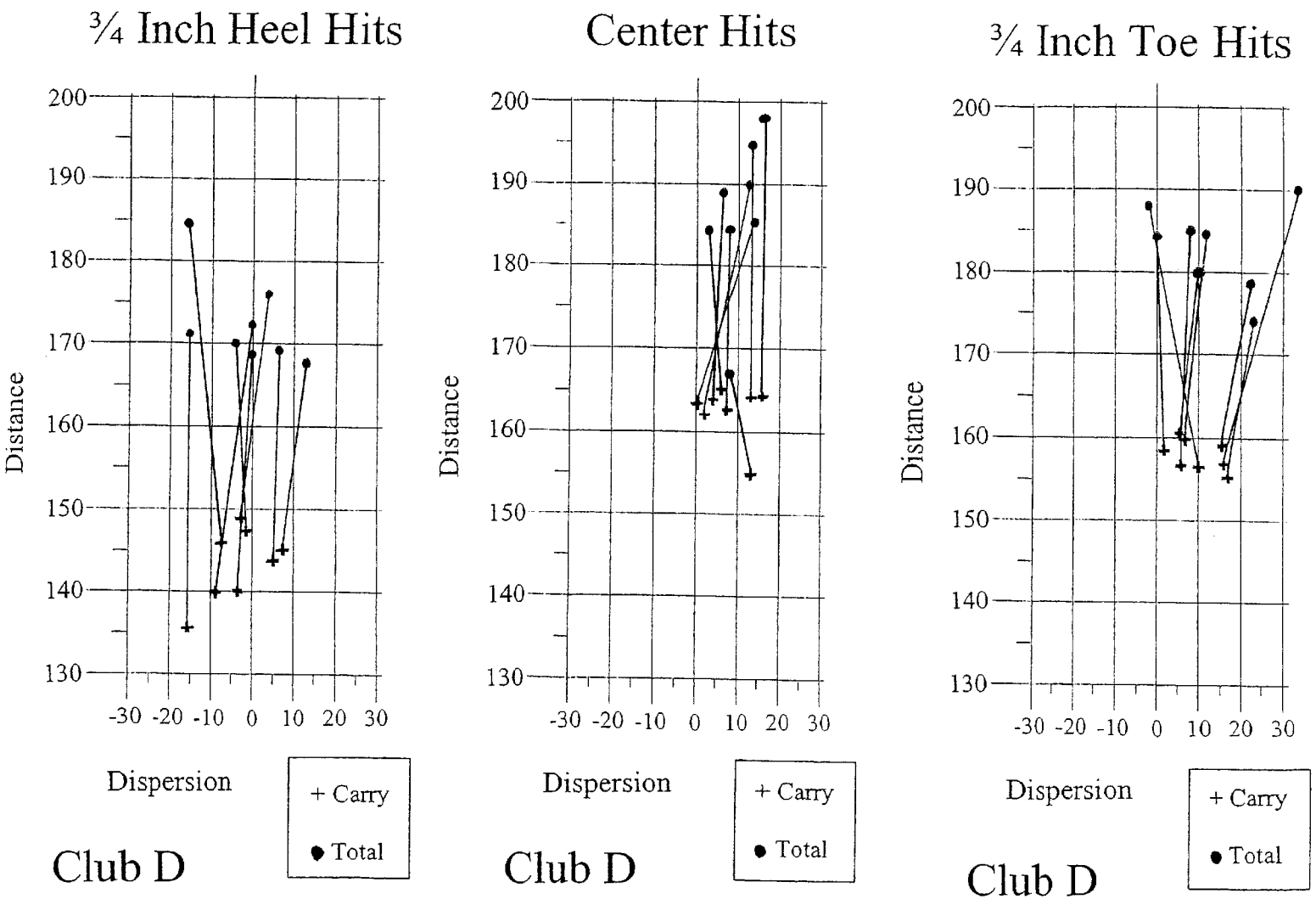
FIG. 17 is a graphical summary of independent laboratory robotic testing of the invention as embodied in Club D.
Figure 21:
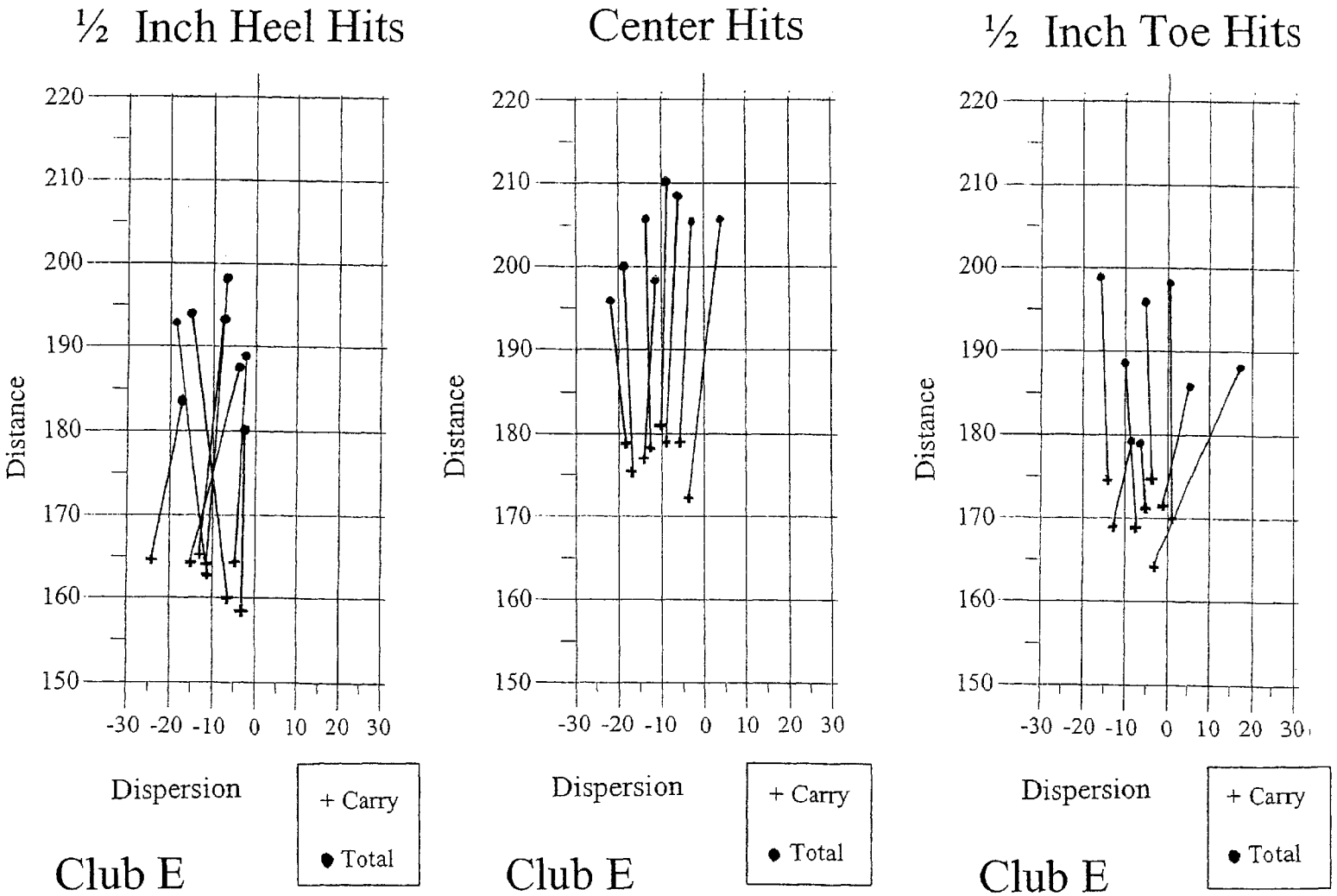
FIG. 21 is a graphical summary of independent laboratory robotic testing of the invention as embodied in Club E.

For example, Club C results are illustrated in FIG. 13. For center hits, the total carry was very uniform in that the balls carried a distance of between 186 and 190 yards. The total distance was also quite uniform in that the resultant overall distance was between 203 and 210 yards. The average dispersion was less than 6 feet off-center. It is significant to note that, as shown in FIG. 13, for the three-quarter inch heel hits, i.e., the balls that were hit off-center at a distance of three-fourths inch towards the heel of the club yielded slightly less carry, i.e., 164 to 176 yards, and somewhat less total distance (i.e., 186–199 yards) but the overall average dispersion was 6.25 feet off-center, just slightly more than center hit dispersion. I also observed that the side spin imparted to the shots hit off-center tended to return the ball to the intended line of flight. This is verified by the overall dispersion of both the carry and the total distance being quite similar to that achieved for the center hits.

My overall conclusion is that the new clubhead design achieves excellent results for off-center hits where the clubface is normal to the intended target line at impact. A minimum loss of distance is achieved for off-center hits, ranging from about 5% to 9% loss of distance. Perhaps more significant, the dispersion ranged from about 5 to 10 yards (15 to 30 feet) for off-center and center hits. The term "dispersion," as used herein and in the claims, means the total range of dispersion, i.e., the distance in yards from the final position of the ball that went furthest left of the target line to the final position of the ball that went furthest right of the target line for hits where the clubface is normal to the intended target line at the moment of impact. The phrase "center of gravity," as used herein and in the claims, is for the clubhead without the hosel. These are surprisingly good results for off-center hits. I attribute these results to the very small moment arm imparted to off-center hits, that small moment arm being achieved by the center of gravity being very close to the flat clubface.

The foregoing description of the invention has been presented for purposes of illustration and description and is not intended to be exhaustive or to limit the invention to the precise form disclosed. Modifications and variations are possible in light of the above teaching. The embodiments were chosen and described to best explain the principles of the invention and its practical application to thereby enable others skilled in the art to best use the invention in various embodiments and with various modifications suited to the particular use contemplated. The scope of the invention is to be defined by the following claims.

What is claimed is:

1. A golf clubhead wherein a metallic clubhead has a heel portion adapted to receive a tubular club shaft, comprising:

a flat clubface having no bulge or roll radius, and wherein said clubface has an overall length from heel to toe of between 4.0 to 4.1 inches, said clubhead having a generally flat rear surface parallel to said clubface, said clubhead having an overall thickness between said clubface and said rear surface of less than 0.40 inch, said clubhead having a center of gravity less than 0.20 inch behind said clubface, whereby a minimal moment arm is created when said clubhead strikes a ball off-center, and whereby said minimal moment arm tends to impart a small amount of side spin to the ball to return the flight of the ball to its intended path.

2. The clubhead of claim 1 further comprising a shallow, spherical recess formed in said rear surface and wherein said center of gravity is less than 0.15 inch behind said clubface.

3. The clubhead of claim 1 wherein said flat clubface is symmetrical about a vertical axis extending through the center of gravity of the clubhead.

4. A golf clubhead wherein a metallic clubhead has a heel portion adapted to receive a tubular club shaft, comprising:

a flat clubface having an overall length from heel to toe of between 4.0 to 4.1 inches, said clubhead having a generally flat rear surface, said clubhead having an overall thickness between said clubface and said rear surface of less than 0.40 inch, said clubhead having a center of gravity less than 0.20 inch behind said clubface, whereby a loss of distance for off-center hits within 0.75 inch of the center of gravity is less than 10%.

5. The clubhead of claim 4 further comprising a shallow, spherical recess formed in said rear surface and wherein said center of gravity is less than 0.15 inch behind said clubface.

6. The clubhead of claim 4 wherein said flat clubface is symmetrical about a vertical axis extending through the center of gravity of the clubhead.

7. The clubhead of claim 4 wherein the resulting dispersion for off-center hits within 0.75 inches of the center of gravity is less than 10 yards when the clubface is normal to the intended target line at impact.

* * * * *